US005411313A

United States Patent [19]

Counihan et al.

[11] Patent Number: 5,411,313

[45] Date of Patent: May 2, 1995

[54] PORTABLE SEATING DEVICE

[76] Inventors: Noel Counihan; Paul Counihan, both of Montana, Piperstown, Tallaght, Dublin 24, Ireland

[21] Appl. No.: 142,989

[22] Filed: Oct. 29, 1993

[30] Foreign Application Priority Data

Oct. 29, 1992 [GB] United Kingdom ..... 9223765
Feb. 10, 1993 [IE] Ireland ..... 930092

[51] Int. Cl.[6] ..... A45B 5/00

[52] U.S. Cl. ..... 297/118; 135/66; 297/217.1

[58] Field of Search ..... 297/118, 217, 129; 135/66, 74

[56] References Cited

U.S. PATENT DOCUMENTS

| | | | |
|---|---|---|---|
| 177,025 | 5/1876 | Smith | 135/66 |
| 295,216 | 3/1884 | Wright | 297/118 X |
| 954,473 | 4/1910 | Schocke | 135/66 X |
| 4,869,280 | 9/1989 | Ewing | 135/74 X |

FOREIGN PATENT DOCUMENTS

| | | | |
|---|---|---|---|
| 607981 | 7/1926 | France | 135/66 |
| 298344 | 10/1928 | United Kingdom . | |
| 625457 | 6/1949 | United Kingdom . | |
| 868541 | 5/1961 | United Kingdom . | |
| 2209276 | 5/1989 | United Kingdom . | |
| 2221148 | 1/1990 | United Kingdom . | |

*Primary Examiner*—Peter R. Brown
*Attorney, Agent, or Firm*—Jacobson, Price, Holman & Stern

[57] ABSTRACT

A portable seating device 1 comprises a shaft 2, a seat 4 and a handle 5. The shaft 2 and handle 5 are pivotally mounted for movement from a seating position with the seat 4 substantially horizontal to a walking position with the handle 5 forming an extension of the shaft 2 and the seat 4 pivoted to the side of the shaft 2 and handle 5.

16 Claims, 4 Drawing Sheets

PORTABLE SEATING DEVICE

The invention relates to portable seating devices and in particular to devices which have dual purpose such as for a walking stick or a seat.

Various attempts have been made to provide such portable seating devices. For example, a conventional shooting stick comprises a shaft having a pair of handles and a length of fabric extending between the handles. The handles are moved from an inner walking position to an outer seating position in which the handles are splayed and the length of fabric extends between the handles to provide a seat. Such shooting sticks are of limited application, are relatively bulky and are generally not sufficiently durable. Various other portable seating devices are also known.

There is a need for an improved seating device.

Some objects of the invention are to provide a portable seating device which is simple to use, economical to manufacture, strong, durable, light and relatively compact.

According to the invention there is provided a portable seating device comprising a shaft, a seat and a mounting element between the shaft and seat, the seat being mounted to the mounting element for movement between a walking position extending along the shaft to a seating position extending substantially perpendicularly of the shaft.

In a particularly preferred embodiment of the invention a handle is provided for the shaft, the handle forming an extension of the shaft in the walking position.

In one embodiment of the invention the handle is mounted for movement between a walking position in line with the longitudinal axis of the shaft and a seating position in which the handle is moved out of line with the axis of the shaft. Preferably the handle is mounted to the mounting element for movement between the walking and seating positions. Most preferably the handle is pivotally mounted to the mounting element.

In a preferred embodiment of the invention the handle and shaft have mating ends which are arranged for interengagement in the walking position. Preferably, one of the handle and shaft ends defines a spigot for engagement in a socket defined by the other of the handle or shaft end. Ideally, biassing means is provided for biassing the shaft and handle into engagement in the walking position.

In one embodiment of the invention the seat has a centre of gravity which in the seating position is located substantially on a longitudinal axis of the shaft. Preferably the seat is pivotally mounted to the mounting element.

In one embodiment of the invention the mounting element is provided on the underside of the seat and includes a first socket for receiving the handle and a second socket for receiving the shaft in the seating position. Preferably, the mounting element includes a sleeve portion in which the shaft and handle are mounted for movement between the walking and seating positions. Typically the shaft and handle are pivotally mounted on respective shaft and handle pivot pins provided in the sleeve portion. The pivot pins may extend across the sleeve through a longitudinally elongate slot in the respective handle and shaft.

The biassing means may be provided by a first spring between the shaft and the shaft pivot and a second spring between the handle and the handle pivot. Preferably, the sleeve portion comprises a pair of spaced-apart plate members on the underside of the seat adjacent to the socket portions.

Preferably the shaft includes a ground engaging trip. In a preferred arrangement the tip includes a friction gripping means, preferably of resilient material.

In another embodiment of the invention the shaft comprises the shaft of an umbrella or the like.

In one embodiment of the invention the length of the shaft is adjustable.

The invention will be more clearly understood from the following description thereof given by way of example only with reference to the accompanying drawings, in which.

Figure 1:
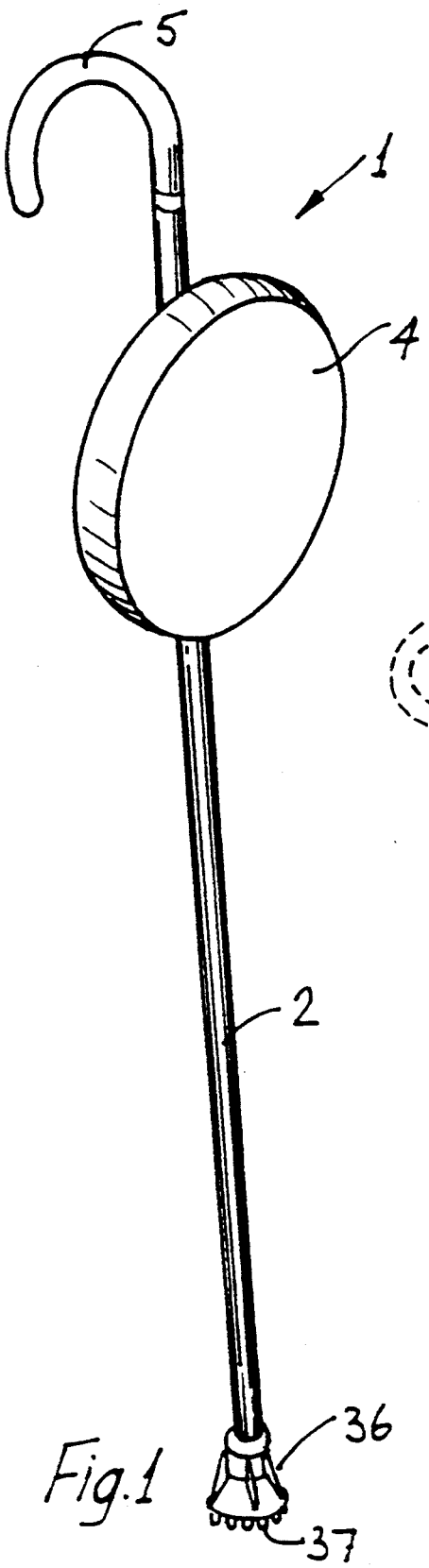
FIG. 1 is a perspective view of a portable seating device according to the invention in a walking position.
Figure 4:
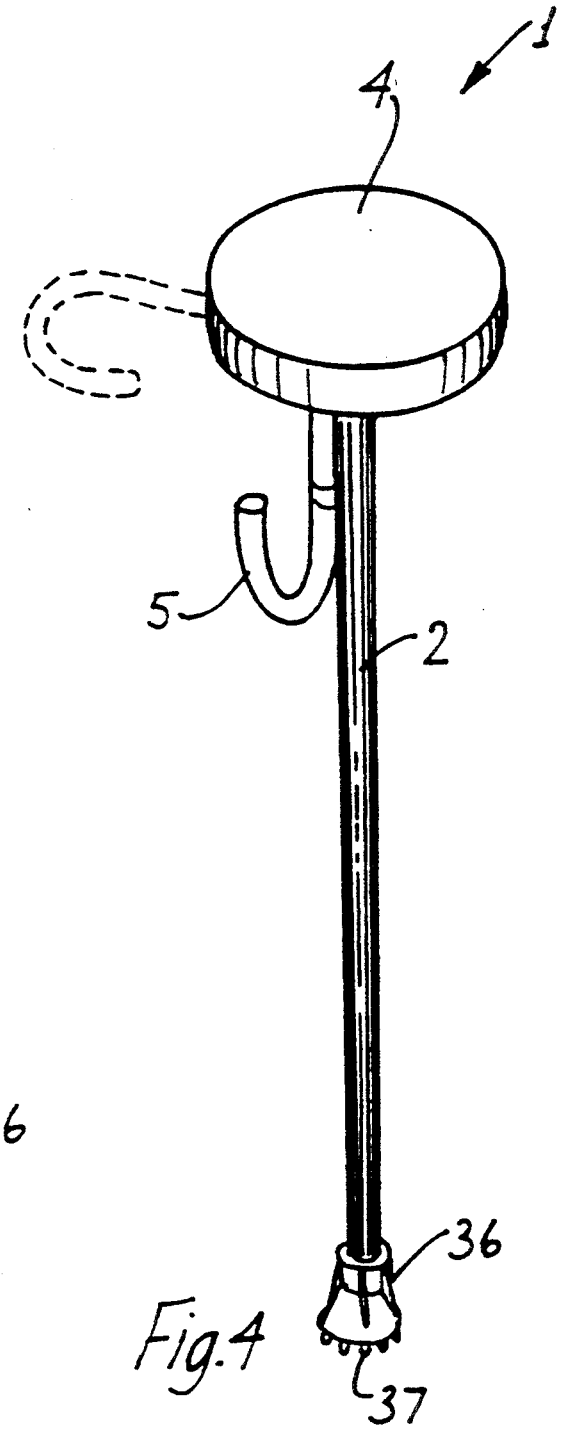
FIG. 4 is a perspective view of the device in a seating position.
Figure 2:
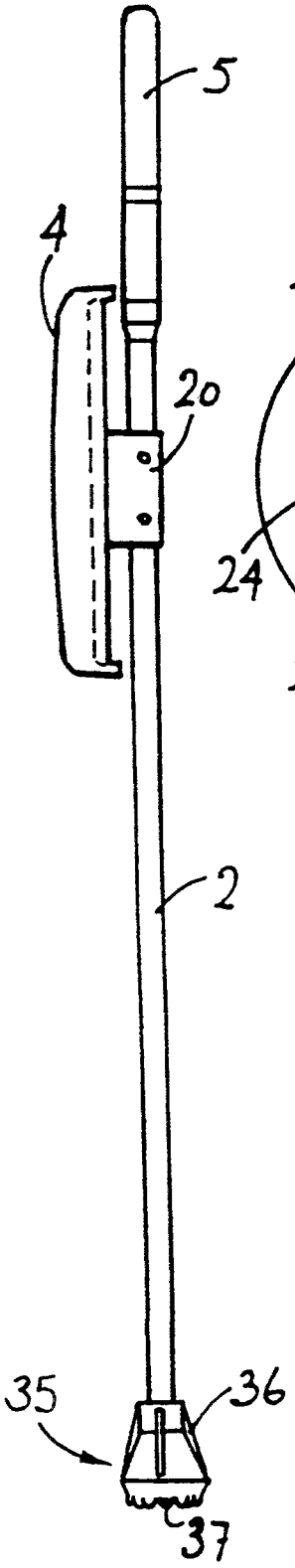
FIG. 2 is a side view of the device of FIG. 1.
Figure 3:
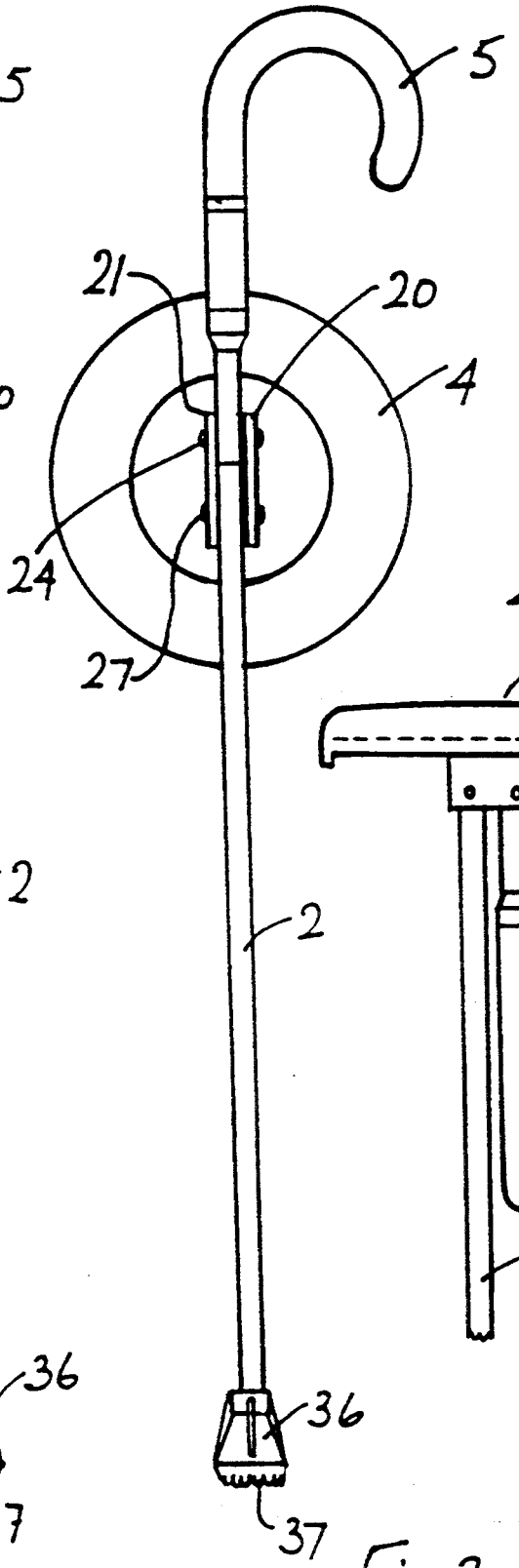
FIG. 3 is a rear view of the device of FIG. 1.
Figure 5:
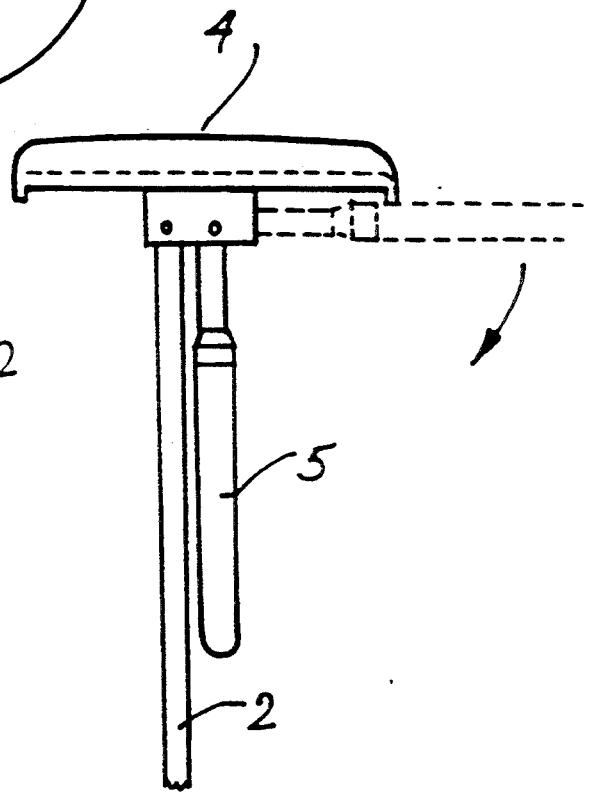
FIG. 5 is a side view of an upper part of the device in a seating position.
Figure 8:
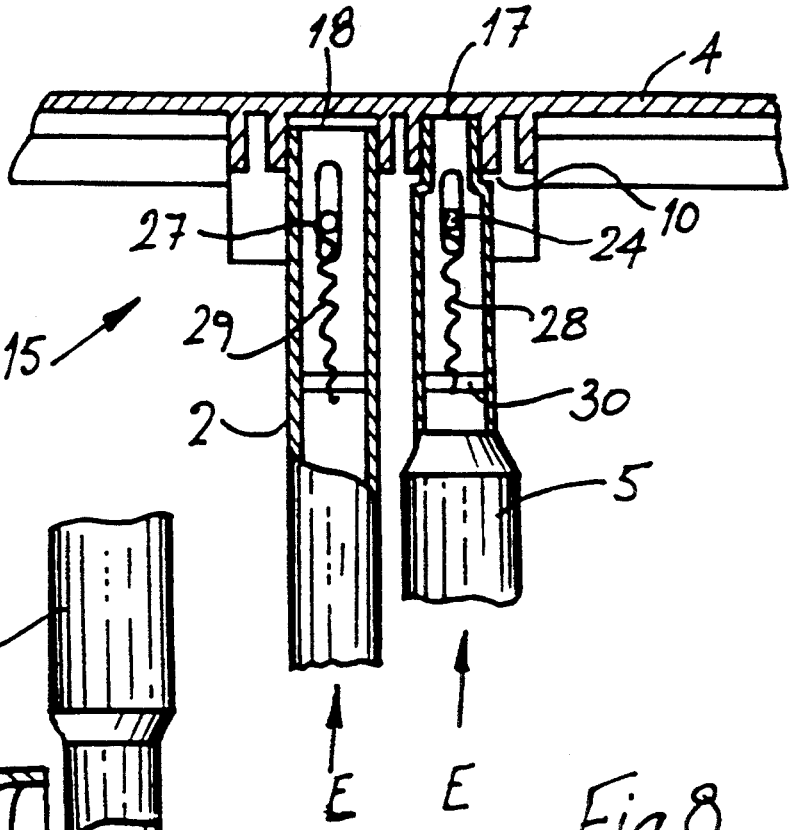
FIG. 8 is a cross sectional view similar to FIG. 6 in a seating position.
Figure 6:
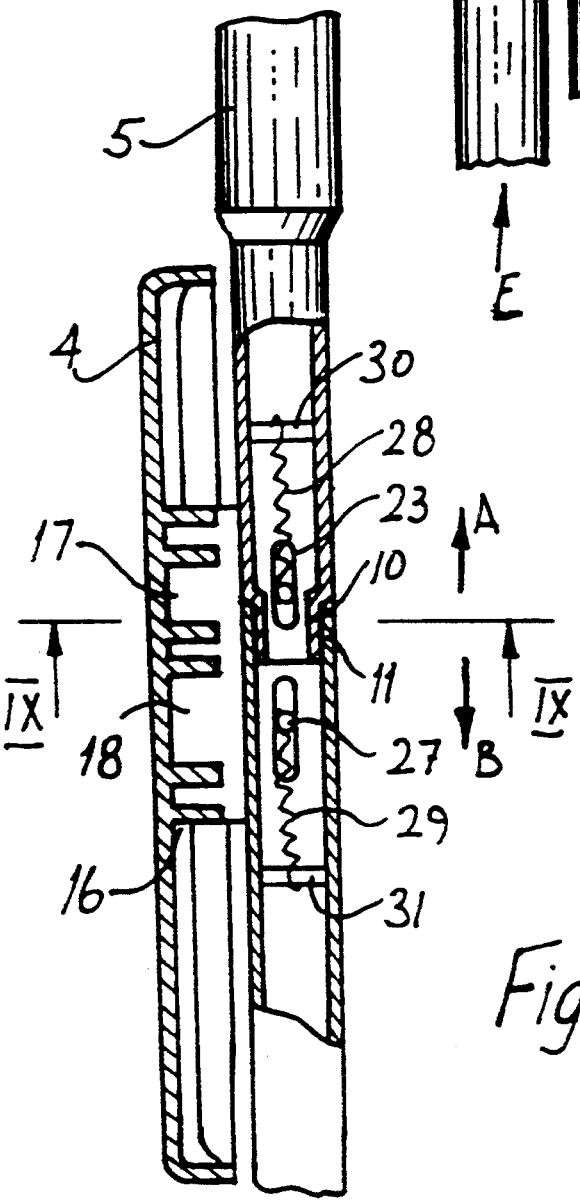
FIG. 6 is a longitudinal cross sectional view of the device in a walking position.
Figure 9:
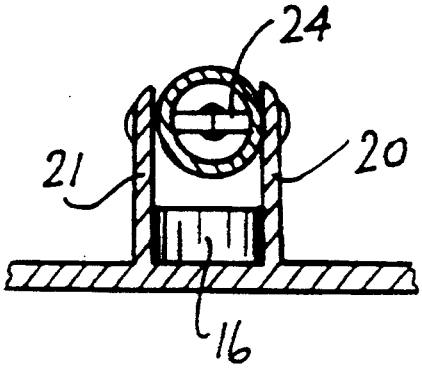
FIG. 9 is a transverse cross sectional view on the line IX—IX in FIG. 6.

Referring to the drawings there is illustrated a seating device according to the invention and indicated generally by the reference numeral 1. The device 1 comprises a shaft 2, a seat 4 and a handle 5. The seat 4 and the handle 5 are movable from the walking position illustrated in FIGS. 1 to 3 and 6 in which the device essentially provides a walking stick to the seating position illustrated in FIGS. 4, 5 and 8 in which the device provides a seat for supporting a user, for example, while waiting for a bus or train, or as a spectator, for example at a sporting event.

Both the shaft 2 and handle 5 are of generally hollow construction and engagement means between the shaft 2 and handle 6 is in this case provided by a spigot portion 10 at a lower end of the handle 5 which is engagable in a complementary socket portion 11 at an upper end of the shaft 2.

A mounting element 15 to which both the handle 5 and shaft 2 are mounted is provided on the underside of the seat 4. The mounting element comprises a socket portion 16 having a handle socket 17 for receiving the spigot end 10 of the handle 5 and a shaft socket 18 for receiving the socket end 11 of the shaft 2 in the seating position as illustrated particularly in FIG. 8. The mounting element 15 also includes a pair of plate members 20,21 which are spaced-apart to define therebetween a sleeve portion in which the shaft 2 and handle 5 are pivotally mounted. The spigot end of the handle 5 includes aligned longitudinally elongate slots 23 through which a handle pivot pin 24 extends. The pin 24 is fixed to and extends between the plate members 20,21. Similarly, the socket end of the shaft 2 includes aligned elongate slots 26 through which a shaft pivot 27 extends. The pin 27 is also fixed to and extends between the plate members 20,21. Biassing means provided by a handle coil spring 28 and a shaft coil spring 29 extend between the respective pivot pins 24,27 and fixed locations 30,31 respectively on the handle 5 and shaft 2 to bias the handle spigot 10 and shaft socket 11 into the engaged walking position illustrated in FIG. 6.

Figure 7:
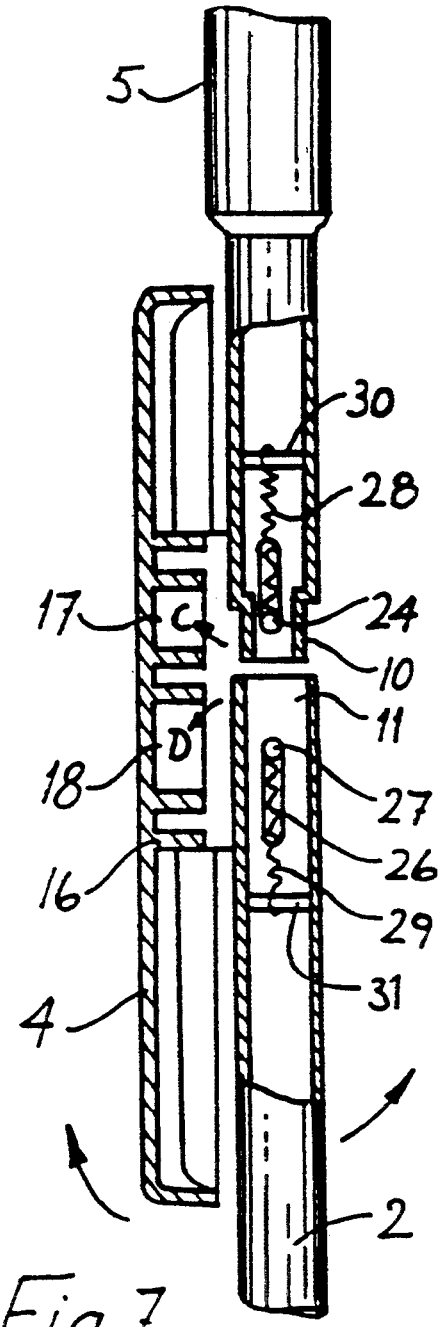
FIG. 7 is a cross sectional view similar to FIG. 6 in an intermediate position.

In use, when the device is in the walking position the handle 5 is coaxial with the shaft 2 and the spigot 10 is engaged in the socket 11. In this walking configuration the seat 4 extends substantially parallel to the shaft 2. When it is desired to convert the device into a temporary seat the handle spigot 10 is disengaged from the shaft socket 11 by pulling them apart in the direction of the arrows A, B in FIG. 6 against the biassing of the springs 28, 29. The shaft 2 and handle 5 are then in the intermediate position illustrated in FIG. 7. The handle 5 and shaft 2 are then turned in the direction of the arrows C and D respective through substantially 90° until the handle spigot 10 and shaft socket 11 are aligned with the sockets 17 and 18 respectively of the socket of the mounting element 15. The handle 5 and shaft 2 are then released allowing the handle spigot 10 to pass into the socket 17 and the shaft socket 11 to pass into the socket 18 under the biassing of the springs 28, 29, respectively.

A pushing force may also be applied in the direction of the arrows E (see FIG. 8), if required. The seat 4 is then in a seating position extending substantially perpendicularly to the longitudinal axis of the shaft 2 so that the weight applied to the seat is directed through the shaft 2 to the ground giving a particularly stable seat when a user is sitting on the seat 4 and further supporting himself by engaging his feet against the ground.

The procedure described above is reversed to re-configure the device as a walking stick.

The shaft 2 is provided with an enlarged tip 35 which is covered by a friction resistant medium such as a tip cover 36 of a suitable flexible plastics or rubber material. It will be noted that the tip cover 36 includes outwardly extending projections 37 for improved grip.

It will be appreciated that the shaft may be the shaft of an umbrella or the like. The length of the shaft may be adjustable.

Many variations on the specific embodiment of the invention will be readily apparent and accordingly the invention is not limited to the embodiments hereinbefore described which may be varied in construction and detail.

We claim:

1. A portable seating device which is convertible from a walking cane configuration to a seating configuration comprising:

a shaft having a lower ground engaging portion and an upper end portion;

a handle having a lower end portion;

a seat having an upper seating surface and an underside;

a mounting element on the underside of the seat, the mounting element having handle receiving means for receiving the lower end portion of the handle in the seating configuration and shaft receiving means for receiving the upper end portion of the shaft, in the seating configuration;

wherein the shaft upper end portion and the handle lower end portion are pivotally mounted on the mounting element; and wherein the handle and shaft are movable relative to the mounting element, from the walking cane configuration, in which the lower end portion of the handle is engaged with the upper end portion of the shaft, to the seating configuration, in which the lower end portion of the handle is engaged with the handle receiving means of the mounting element and the upper end portion of the shaft is engaged with the shaft receiving means of the mounting element on the underside of the seat.

2. The seating device as claimed in claim 1, wherein one of the handle lower end portion or shaft upper end portion defines a spigot for engagement in a socket defined by the other of the handle lower end portion or shaft upper end portion.

3. The seating device as claimed in claim 1, wherein biassing means is provided between the handle lower end portion and shaft upper end portion for biassing the shaft and handle into engagement in the walking cane configuration.

4. The seating device as claimed in claim 1, wherein the seat has a center of gravity which in the seating configuration is located substantially on a longitudinal axis of the shaft.

5. The seating device as claimed in claim 1, wherein the handle receiving means of the mounting element comprises a first socket for receiving the handle lower end portion and the shaft receiving means of the mounting element comprises a second socket for receiving the shaft upper end portion in the seating configuration.

6. The seating device as claimed in claim 5, wherein the mounting element includes a sleeve portion, the shaft upper end portion being mounted in one part of the sleeve portion and the handle lower end portion being mounted in another part of the sleeve for pivotal movement of the shaft end portion and handle lower end portion between the walking and seating configurations.

7. The seating device as claimed in claim 6, wherein the shaft upper end portion and handle lower end portion are mounted on a shaft pivot pin and a handle pivot pin, respectively.

8. The seating device as claimed in claim 7, wherein each of said pivot pins extend across the sleeve portion through a longitudinally elongate slot in the respective handle lower end portion and shaft upper end portion, the slots being drawn through the slots on movement of the handle end portion and shaft end portion between the walking and seating configurations.

9. The seating device as claimed in claim 8, wherein biassing means is provided by a first spring between the shaft upper end portion and the shaft pivot pin and a second spring between the handle lower end portion and the handle pivot pin.

10. The seating device as claimed in claim 6, wherein the sleeve portion comprises a pair of spaced-apart plate members on the underside of the seat.

11. The seating device as claimed in claim 1, wherein the shaft includes a ground engaging tip.

12. The seating device as claimed in claim 11, wherein the tip includes a friction gripping means.

13. The seating device as claimed in claim 12, wherein the friction gripping means is of resilient material.

14. The seating device as claimed in claim 11, wherein said ground engaging tip comprises a plurality of outwardly extending projections.

15. The seating device as claimed in claim 1, wherein the length of the shaft is adjustable.

16. A portable seating device which is convertible from a walking cane configuration to a seating configuration comprising:

a shaft having a lower ground engaging portion and an upper end portion;

a handle having a lower end portion;

a seat having an upper seating surface and an underside;

a mounting element on the underside of the seat, the mounting element having means for receiving the lower end portion of the handle in the seating configuration and means for receiving the upper end portion of the shaft in the seating configuration;

wherein the shaft upper end portion and the handle lower end portion are pivotally mounted on the mounting element;

wherein the handle and shaft are movable relative to the mounting element, from the walking cane configuration, in which the lower end portion of the handle is engaged with the upper end portion of the shaft, to the seating configuration, in which the lower end portion of the handle is engaged with the handle receiving means of the mounting element and the upper end portion of the shaft is engaged with the shaft receiving means of the mounting element on the underside of the seat; and a biassing means provided between the handle lower end portion and shaft upper end portion for biassing the shaft and handle into engagement in the walking position.

* * * * *